US006418288B2

(12) United States Patent
Saitoh

(10) Patent No.: US 6,418,288 B2
(45) Date of Patent: Jul. 9, 2002

(54) CARRIER COLLECTION DEVICE AND METHOD THEREFOR

(75) Inventor: Junichi Saitoh, Yamagata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/785,324

(22) Filed: Feb. 20, 2001

(30) Foreign Application Priority Data

Feb. 18, 2000 (JP) ..... 2000-041044

(51) Int. Cl.[7] ..... G03G 15/10
(52) U.S. Cl. ..... 399/250; 399/237; 430/117
(58) Field of Search ..... 399/250, 237, 399/249, 251; 430/117; 210/739, 767, 770

(56) References Cited

U.S. PATENT DOCUMENTS 5,884,128 A * 3/1999 Park ..... 399/250
6,011,943 A * 1/2000 Kim ..... 399/237 X
6,314,260 B1 * 11/2001 Watanabe ..... 399/250

FOREIGN PATENT DOCUMENTS

JP 11-184344 7/1999
JP 11-327402 11/1999
JP 2000-275970 * 10/2000

* cited by examiner

*Primary Examiner*—Sophia S. Chen

(57) ABSTRACT

A carrier collection device having an absorption belt, a heat source, a vapor collection tube, an absorption device, a condenser, a foaming member. The absorption belt absorbs a carrier from a developer, including a toner and the carrier, after being used for developing an electrostatic latent image on a photo-conductor. The heat source generates a carrier vapor from the absorption belt. The vapor collection tube surrounds the absorption belt. The absorption device absorbs the carrier vapor from the vapor collection tube. The condenser is arranged between the vapor collection tube and the absorption device. The condenser stores a coolant carrier in advance, includes a foaming member for foaming the carrier from the carrier vapor. Further, the condenser receives the carrier vapor from the vapor collection tube, condenses the received carrier vapor through the coolant carrier and the foaming member, and stores the condensed carrier together with the coolant carrier.

18 Claims, 7 Drawing Sheets

CARRIER COLLECTION DEVICE AND METHOD THEREFOR

BACKGROUND OF THE INVENTION

1. Field of the Invention

The present invention relates to a carrier collection device and a method therefor, and more particularly, to a carrier collection device and a method, for collecting a liquid carrier from a developer for use in a wet-type electrophotographic printer.

2. Description of the Related Art

In a wet-type electrophotographic image forming apparatus (printer), including a printer, copier, facsimile machine, etc., a developer which is composed of a solid toner and a liquid carrier is adhered to an electrostatic latent image on a photo-conductor. If a high percentage of a liquid (carrier) is included in the adhered developer, the quality of the image output onto a paper, etc. is deteriorated. Hence, in the wet-type electrophotographic printer, the carrier needs to be collected from the developer adhered onto the photo-conductor.

A device for collecting the carrier is disclosed in Unexamined Japanese Patent Application KOKAI Publications Nos. H11-184344 and H11-327402.

Such a carrier collection device absorbs the carrier from the developer on the photo-conductor, with an absorption member, and heats the absorption member included inside a manifold. In this way, after a carrier vapor is generated by the heat inside the manifold, the carrier vapor is condensed by a condenser, so as to collect a liquid carrier. The manifold has an opening, so that the absorption member which is dried inside the manifold can absorb the carrier from the developer on the photo-conductor. In this structure, a problem arises in that the carrier vapor is scattered inside the carrier collection device from the opening.

To promote the efficiency with which the carrier is collected, it is necessary to enhance the efficiency with which the carrier is liquefied by the condenser, and to collect the carrier vapor flowing from the opening of the manifold.

In the case of the manifold included in the carrier collection device, which is disclosed in Unexamined Japanese Patent Application KOKAI Publication No. H11-184344, the carrier vapor vaporized from the absorption member can not be prevented from being scattered from the opening of the manifold inside the carrier collection device.

In the carrier collection device, which is disclosed in Unexamined Japanese Patent Application KOKAI Publication No. H11-327402, there is a member for filling the space between the manifold and the absorption member. However, in this carrier collection device, an area adjacent to the photo-conductor and the absorption member can not completely be filled up. Hence, in the carrier collection device disclosed in this publication, the carrier vapor which is vaporized from the absorption member can not be prevented from being scattered around inside the carrier collection device.

The problem thus is that an internal space of the carrier collection device is filled with the carrier vapor, which has not been collected yet, because the carrier vapor vaporized from the absorption member can not be collected. The carrier vapor scattered around inside the carrier collection device can not completely melts in the air, if the concentration of the carrier is high. If the room temperature is 10° C., for example, the carrier is dew-condensed, when the concentration of the carrier inside the carrier collection device is approximately 260 ppm, and adhered to any plastic, rubber, electric parts inside the device. If the carrier includes a large amount of hydrocarbon solvent, the liquefied carrier causes the plastic, rubber, electric parts to be deteriorated.

SUMMARY OF THE INVENTION

It is accordingly an object of the present invention to provide a carrier collection device and a method for efficiently collecting a carrier.

In order to achieve the above object, according to the first aspect of the present invention, there is provided a carrier collection device for collecting a carrier from a developer, including a toner and the carrier, after being used for developing an electrostatic latent image formed on a photo-conductor, the device comprising:

- an absorption belt which is arranged adjacent to the photo-conductor, and rotated in a direction opposite to a rotational direction of the photo-conductor, so as to absorb the carrier;
- a heat source which heats the absorption belt, and generates a carrier vapor from the absorption belt;
- a vapor collection tube which surrounds the absorption belt and has a vent for the carrier vapor;
- an absorption device which absorbs the carrier vapor from the vent of the vapor collection tube; and
- a condenser which
  - is arranged between the vapor collection tube and the absorption device,
  - stores, in advance, a coolant carrier,
  - includes a foaming member for foaming a carrier included in the carrier vapor, on the coolant carrier,
  - receives the carrier vapor from the vapor collection tube,
  - condenses the received carrier vapor through the coolant carrier and the foaming member, and
  - stores the condensed carrier together with the coolant carrier.

In order to achieve the above object, according to the second aspect of the present invention, there is provided a carrier collection device for collecting a carrier from a developer, including a toner and the carrier, after being used for developing an electrostatic latent image formed on a photo-conductor, the device comprising:

- an absorption belt which is arranged adjacent to the photo-conductor, and absorbs the carrier by rotating in a direction opposite to a rotational direction of the photo-conductor;
- a heat source which heats the absorption belt and generates a carrier vapor;
- a vapor collection tube which includes an opening in an area adjacent to the photo-conductor and the absorption belt, surrounds the absorption belt, and has a vent for the carrier vapor;
- an absorption device which absorbs the carrier vapor from the vent of the vapor collection tube;
- a condenser which receives the carrier vapor from the vent of the vapor collection tube, condenses the received carrier vapor, and collects the condensed carrier;
- a duct one end of which partially or fully covers the opening of the vapor collection tube, and other end of which is connected to the condenser; and
- a fan which is included in the duct, and collects the carrier vapor flowing from the opening of the vapor collection tube.

In order to achieve the above object, according to the third aspect of the present invention, there is provided a carrier collection device for collecting a carrier from a developer, including a toner and the carrier, after being used for developing an electrostatic latent image formed on a photo-conductor, the device comprising:

an absorption belt which is arranged adjacent to the photo-conductor, and rotated in a direction opposite to a rotational direction of the photo-conductor, thereby to absorb the carrier;

a heat source which heats the absorption belt, and generates a carrier vapor;

a vapor collection tube which includes an opening in an area adjacent to the photo conductor and the absorption belt, surrounds the absorption belt, and includes a vent for the carrier vapor;

an absorption device which absorbs the carrier vapor from the vent of the vapor collection tube;

a condenser which receives the carrier vapor from the vent of the vapor collection tube, condenses the received carrier vapor, and collects the condensed carrier; and a photo-conductor cover which is connected to the opening of the vapor collection tube, and partially or fully covers a surface of the photo-conductor from the opening.

In order to achieve the above object, according to the fourth aspect of the present invention, there is provided a method for collecting a carrier from a developer, including a toner and the carrier (liquid), after being used for developing an electrostatic latent image on a photo-conductor, the method comprising:

absorbing the carrier from the photo-conductor onto an absorption belt;

heating and vaporizing the carrier absorbed onto the absorption belt with a heat source;

absorbing, with an absorption device, the carrier vapor vaporized in the heating, and conducting the absorbed carrier vapor to a condenser in which a coolant carrier is stored in advance;

cooling and condensing the carrier vapor, which is absorbed in the absorbing, in the coolant carrier stored in advance in the condenser, and storing the condensed carrier; and foaming the carrier vapor, which has passed through the coolant carrier, using a foaming member arranged on the coolant carrier, condensing the foamed carrier by retaining the foamed carrier on the foaming member for a predetermined period of time, and storing the condensed carrier in the condenser.

BRIEF DESCRIPTION OF THE DRAWINGS

The object and other objects and advantages of the present invention will become more apparent upon reading of the following detailed description and the accompanying drawings in which.

DETAILED DESCRIPTION OF THE PREFERRED EMBODIMENTS

First Embodiment

A wet-type electrophotographic printer of preferred embodiments of the present invention will now be described with reference to the accompanying drawings.

Figure 1:
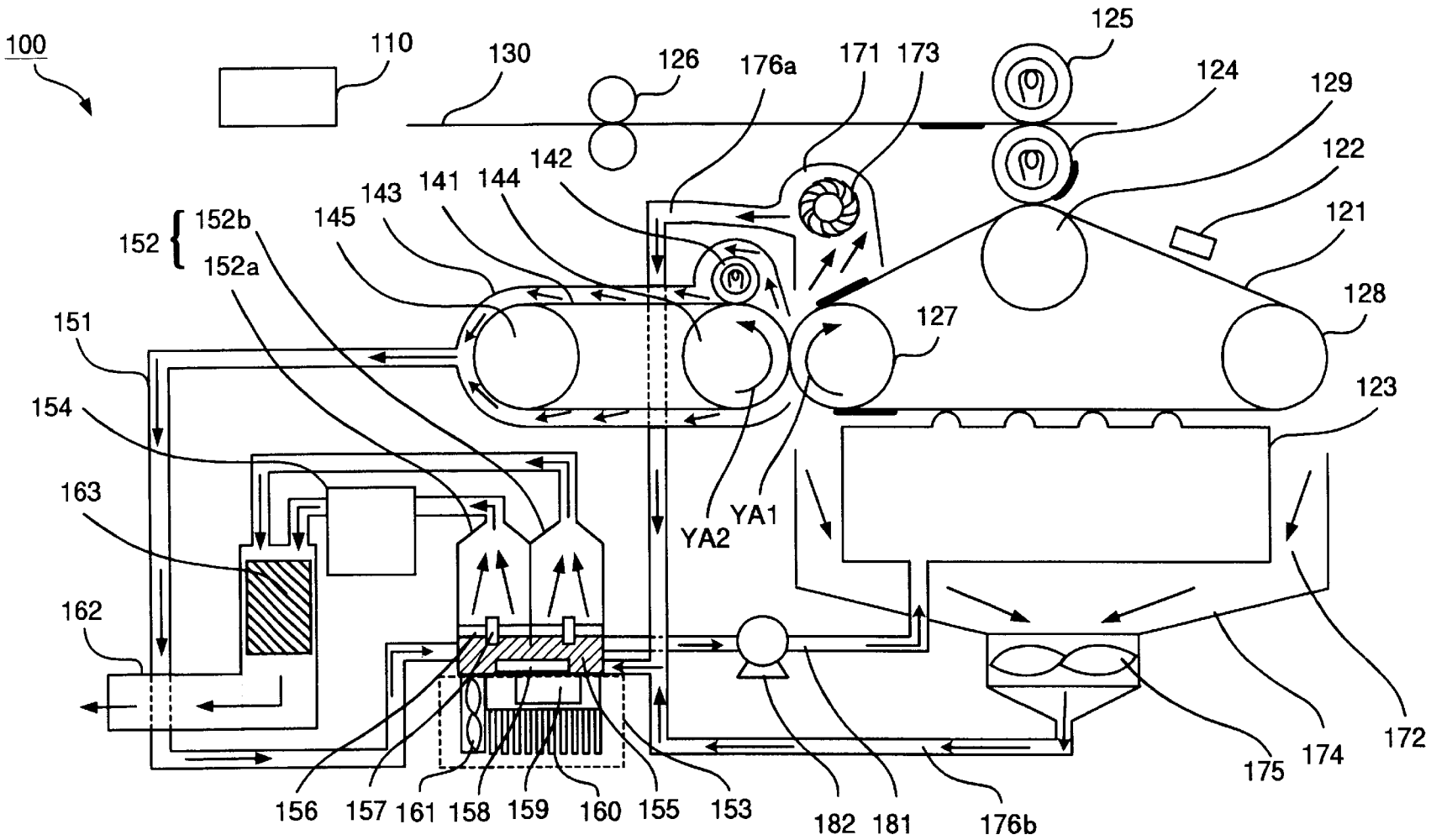
FIG. 1 is a diagram showing the structure of a wet-type electrophotographic printer according to the first embodiment of the present invention.

FIG. 1 shows the structure of a wet-type photographic printer according to the first embodiment of the present invention.

A wet-type electrophotographic printer 100 shown in FIG. 1 collects a remaining liquid (carrier) which is included in a developer for use in printing. The developer is composed of a liquid carrier, a solid toner, and a fixing agent.

The wet-type electrophotographic printer 100 performs the following processes, including a process for printing predetermined images, a process for vaporizing the carrier, a process for collecting and condensing a vaporized carrier, and a process for recycling a used carrier, under the control of a controller 110.

The wet-type electrophotographic printer 100 comprises a photo-conductor belt 121, a charger 122, a multicolor image formation section 123, a transfer roller 124, a fixation roller 125, an output roller 126.

The photo-conductor belt 121 is driven by a driving roller 127, and is a non-terminated belt which is rotated while being supported between a steering roller 128 and a transfer facing roller 129. The surface of the photo-conductor belt 121 is charged by the charger 122.

The driving roller 127 rotates clockwise, as shown with an arrow YA1.

The multi-color image formation section 123 radiates a laser beam onto a charged section on the photo-conductor belt 121, and exposes the charged section, so as to form an electrostatic latent image. After this, the multi-color image formation section 123 adheres four colors of developers, i.e. yellow, magenta, cyan, and black, onto the surface of the photo-conductor belt 121.

The toner included in the developer is attracted onto the photo-conductor belt 121 by electric charges thereon, and travels in the carrier. Further, the toner is adhered to the photo-conductor belt 121, and forms a toner image corresponding to the electrostatic latent image. In this specification, the formation of such a toner image is referred to as "developing".

The transfer roller 124 approaches the photo-conductor belt 121 while being rotated, receives the toner included in the developer adhered to the photo-conductor belt 121, and fixes the received toner onto a paper 130. In other words, the transfer roller 124 is rotated in synchronization with the photo-conductor belt 121. Thus, the toner image on the photo-conductor belt 121 is transferred onto the surface of the transfer roller 124, and transferred onto the paper 130.

The fixation roller 125 is in contact with the transfer roller 124 via the paper 130, so as to be rotated, and melts the toner which has been transferred onto the transfer roller 124. The melted toner is transferred from the transfer roller 124 onto the paper 130, so as to form visible images. The output roller 126 outputs the recording medium.

The wet-type electrophotographic printer 100 includes a absorption belt 141, a heat roller 142, and a manifold 143. In this structure, the wet-type electrophotographic printer 100 vaporizes the carrier.

The absorption belt 141 is a non-terminated belt, and supported by a rotatable pressure-welding roller 144 and steering roller 145, thereby to be rotated in a direction opposite to the rotational direction of the photo-conductor belt 121 as shown with an arrow YA2. The steering roller 145 stabilizes the movement of the absorption belt 141.

The absorption belt 141 is formed from a PET (Polyethyleneterephthalate) substrate which is 100 $\mu$m in thickness and an absorption layers which is formed of silicon elastomer on the PET substrate.

The absorption belt 141 is arranged adjacent to the pressure-welding roller 144, and contacts the photo-conductor belt 121. An elastic body, such as an urethane sponge, etc. which is several mm in thickness, is wound around the surface of the pressure-welding roller 144. The absorption belt 141 is pressure-welded by the pressure-welding roller 144, and contacts the photo-conductor belt 121, so as to absorb the carrier included in the developer on the photo-conductor belt 121.

The surface of the heat roller 142 is in contact with the surface of the absorption belt 141, in a downstream direction with respect to the contact point of the absorption belt 141 and the photo-conductor belt 121 in the rotational direction of the absorption belt 141.

The heat roller 142 internally includes a heat source, so as to vaporize the carrier which has transported onto the absorption belt 141 with the heat of the heat source.

The manifold 143 covers the outer surface of the absorption belt 141, thereby to prevent that the vapor (carrier vapor) including the carrier vaporized by the heat of the heat source is scattered around. The manifold 143 includes an opening and a vapor vent, whereby the absorption belt 141 contacts the photo-conductor belt 121 at the opening and the carrier vapor is exhausted from the vapor vent.

The wet-type electrophotographic printer 100 includes a carrier vaporization tube 151, a column (condenser) 152, a cooler 153, and a vacuum pump 154. In this structure, the wet-type electrophotographic printer 100 collects and condenses the carrier vapor.

One end of the carrier vaporization tube 151 is connected to the vapor vent, whereas the other end thereof is connected to the column 152. The carrier vapor flows to the column 152 from the vapor vent of the manifold 143 through the carrier vaporization tube 151.

The column 152 includes a coolant carrier (liquid) 155, a foaming member 156, a water-level detector 157, a liquid-temperature detector 158. The column 152 cools and liquefies the carrier vapor, and removes water content from the carrier so as to produce a pure carrier.

The column 152 stores a predetermined amount of coolant carrier (liquid) 155. The column 152 includes the foaming member 156 and the water-level detector 157 above the coolant carrier (liquid) 155. The bottom of the column 152 is made of a material having high thermal conductivity. In addition, the liquid-temperature detector 158 is included inside the column 152.

The inside of the column 152 is partitioned into two, i.e. the first column 152*a* and the second column 152*b*, using a partition which is hung from the ceiling of the column 152 just above the bottom thereof, as shown in FIG. 1.

The carrier vapor flows into the first column 152*a* from the manifold 143 via the carrier vaporization tube 151.

The carrier vapor which is additionally collected, as will be explained later, flows into the second column 152*b*.

The coolant carrier (liquid) 155 is cooled down to a predetermined temperature, and cools down the carrier vapor.

The foaming member 156 has a number of holes, and foams with the liquid penetrating through the holes. The diameter of each hole is approximately 50 $\mu$m, and the foaming member 156 has the porosity of 38%.

The foaming member 156 is formed of a ceramic material including mainly alumina (93%), and silica, titania, etc.

The water-level detector 157 detects that the water level of the coolant carrier (liquid) 155 stored in the column 152 reaches a predetermined water level.

The liquid-temperature detector 158 measures the temperature of the coolant carrier (liquid) 155 stored in the column 152.

The cooler 153 is in contact with the lower section of the column 152, and includes a cooling device 159, a heat sink 160, and a cooling fan 161.

One end of the cooling device 159 is in contact with the outer bottom surface of the column 152, and absorbs heat from the coolant carrier (liquid) 155 stored in the column 152. The other end thereof is connected to the heat sink 160, and emits the absorbed heat.

The cooling device 159 is controlled off by the controller 110, when the liquid-temperature detector 158 detects that the temperature of the carrier (liquid) 155 stored in the column 152 reaches a predetermined temperature.

The heat sink 160 externally emits the heat absorbed by the cooling device 159.

The cooling fan 161 cools the heat sink 160, and quickens the emitting of the heat absorbed from the cooling device 159.

The vacuum pump 154 is arranged between the first column 152*a* and an exhaust duct 162. The vacuum pump 154 absorbs air, etc. inside the first column 152*a*, and outputs the absorbed air to the exhaust duct 162. Along with the absorption of the air inside the first column 152*a*, as performed by the vacuum pump 154, absorption of air, etc. inside the carrier vaporization tube 151 connected to the first column 152*a* is performed as well. Thus, air flows in a direction from the first column 152*a* to the exhaust duct 162 along with the flow inside the carrier vaporization tube 151 and the first column 152. The carrier vapor is absorbed from the manifold 143 along with the flow thereinside.

The carrier vapor flows into the exhaust duct 162 from vents of the respective first column 152 and second column 152*b*.

The exhaust duct 162 includes a filter 163 which is filled with active carbon, etc. After the carrier vapor flows into the exhaust duct 162, the carrier is removed by the active carbon of the filter 163 so as to externally be exhausted.

The wet-type electrophotographic printer 100 further includes a upper duct 171 and a lower duct 172. In this structure, the wet-type electrophotographic printer 100 enhance the collection of the carrier vapor and a secure operation of the printer.

The upper duct 171 collects the carrier vapor which scatters upward from the opening of the manifold 143.

The upper duct 171 covers the opening of the manifold 143 and the surface of the photo-conductor belt 121 in a downstream position from the contact point of the photo-conductor belt 121 and the absorption belt 141 into the rotational direction of the photo-conductor belt 121. The upper duct 171 is connected to the second column 152*b*.

An upper fan 173 is arranged inside the upper duct 171. The upper fan 173 includes a fan which is axially wide like a sirocco fan, for example, and sends the absorbed carrier vapor to the second column 152*b*.

The lower duct 172 collects a very slight amount of carrier vapor, which is vaporized at a room temperature, from the developer inside the multicolor image formation section 123.

The lower duct 172 is arranged at the lower section of the multicolor image formation section 123 and opening of the manifold 143, connected to the second column 152*b*, and includes a tray 174 having a conical shape. A lower fan 175 is arranged at the center of the bottom section of the tray 174. The lower fan 175 includes an airtight fan, such as an axial fan, for example. The lower fan 175 absorbs the carrier vapor collected onto the tray 174, and sends the absorbed carrier vapor to the second column 152*b*.

The upper duct 171 and the lower duct 172 are connected to the second column 152*b* respectively via an auxiliary tube 176a and an auxiliary tube 176*b*.

The wet-type electrophotographic printer 100 includes a carrier tube 181 and a pump 182. In this structure the wet-type electrophotographic printer 100 recycles carrier.

One end of the carrier tube 181 is connected to the column 152, whereas the other and thereof is connected to the multicolor image formation section 123.

The pump 182 is arranged between the column 152 and the multicolor image formation section 123. The pump 182 absorbs the carrier (liquid) stored in the column 152, and sends the absorbed carrier to the multicolor image formation section 123 via the carrier tube 181.

The multicolor image formation section 123 includes an agitator which agitates the contained developer. When the water-level detector 157 detects that the water level of the carrier (liquid) 155 stored in the column 152 reaches a predetermined level, the controller 110 provides the pump 182 with a drive-control signal, and instructs the multicolor image formation section 123 to mix the developer.

The controller 110 controls processes, for example, for driving the photo-conductor belt 121, rollers, fans, pumps, etc., and heating the heat roller 142.

Explanations will now be made to a process in which the wet-type electrophotographic printer 100 shown in FIG. 1 forms images.

As shown with the arrow YA1, the photo-conductor belt 121 rotates clockwise, whereas the absorption belt 141 rotates counter-clockwise, as shown with the arrow YA2.

The multicolor image formation section 123 radiates a laser beam onto the charged section of the photo-conductor belt 121, so as to form an image (electrostatic latent image) with static electricity on the photo-conductor belt 121.

After this, the multicolor image formation section 123 adheres four colors, i.e. yellow, magenta, cyan, and black, of developers onto the surface of the photo-conductor belt 121. The developer includes toner, carrier (liquid) and fixing agent.

The toner included in the developer is attracted onto the photo-conductor belt 121 by the static electricity, travels inside the carrier, and adhered to the charged section of the photo-conductor belt 121. Hence, the toner corresponding to the electrostatic latent image is spread out on the photo-conductor belt 121, thereby forming a visible image (toner image).

Along with the rotation of the photo-conductor belt 121, the section of the photo-conductor belt 121 on which the developer is adhered is rubbed with the absorption belt 141 which is rotated in a direction opposite to the rotational direction of the photo-conductor belt 121.

Hence, the carrier on the photo-conductor belt 121 is scraped out and absorbed by the absorption belt 141. The toner forming the toner image is firmly adhered onto the surface of the photo-conductor belt 121 by the static electricity, thus can not be absorbed by the absorption belt 141.

An appropriate percent of the carrier included in the developer (remaining developer) which remains on the photo-conductor belt 121 is maintained. The toner is fixed onto the transfer roller 124 with the fixing agent included in the remaining developer, melts by the fixation roller 125, and transferred onto the paper 130, thus forming an image.

Explanations will now be made a process for collecting the carrier absorbed by the absorption belt 141, as performed by the wet-type electrophotographic printer 100 in the above process for forming an image, with reference to the flow-chart shown in FIG. 2.

Figure 2:
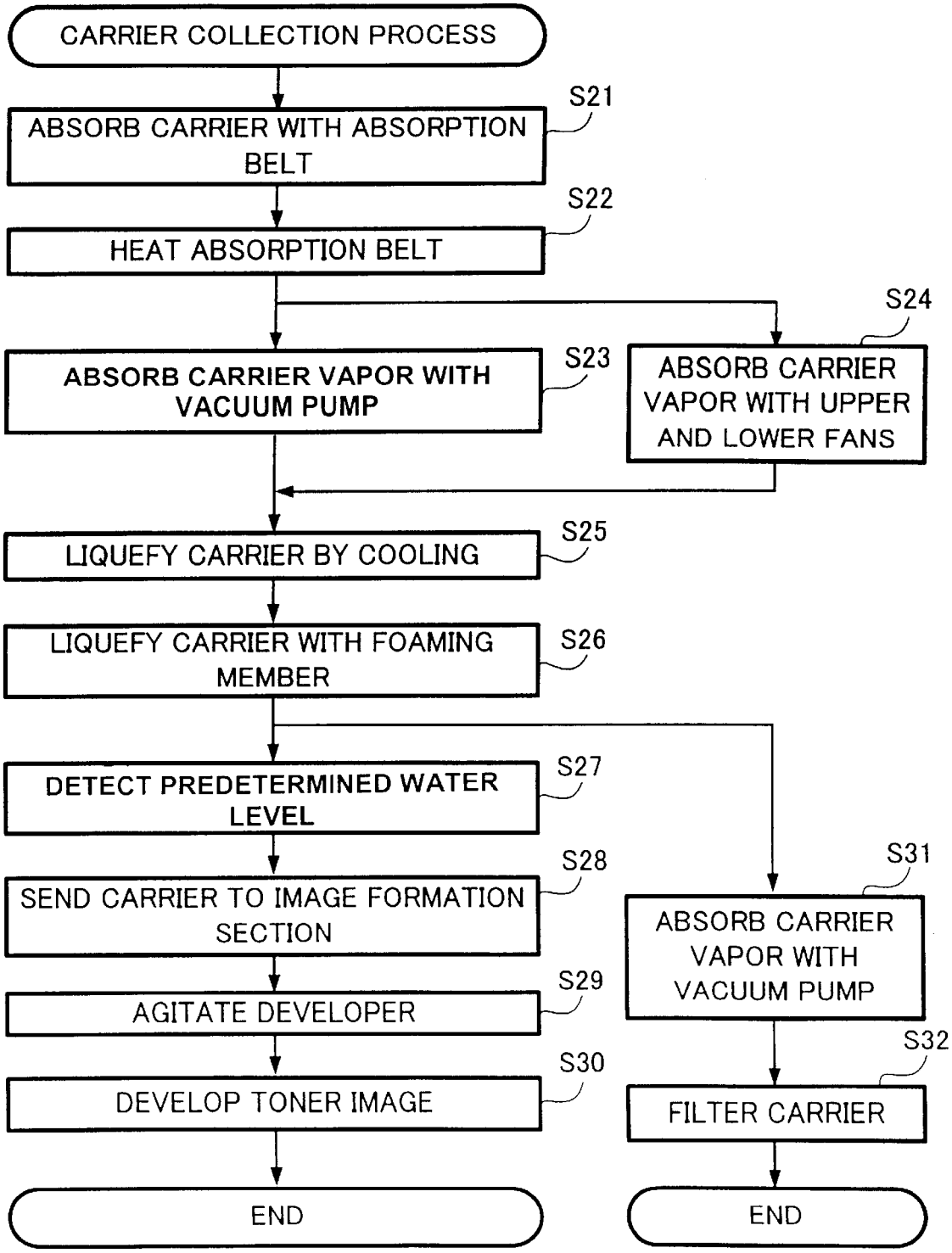
FIG. 2 is a flowchart showing the flow of a carrier collection process carried out by the wettype electrophotographic printer according to the first embodiment.

The flowchart shown in FIG. 2 is not to show that processes are sequentially carried out one after another in the wet-type electrophotographic printer 100. Each composition component of the printer 100 continuously operates. FIG. 2 shows the flow of a carrier collection process which involves each composition component functioning for a particular carrier.

The absorption belt 141 absorbs the carrier from the photo-conductor belt 121 (Step S21).

The surface of the absorption belt 141 is in contact with the heat roller 142. The heat roller 142 is heated up by the heat source included thereinside, thus the absorption belt 141 is heated by the heat roller 142 (Step S22). The carrier absorbed by the absorption belt 141 is welled out into the manifold 143 from the entire surface of the absorption belt 141 in the form of carrier vapor (a mixed vapor of a carrier, vapor, and air). The absorption belt 141 is further rotated, passes through the steering roller 145, and contacts the photo-conductor belt 121 again.

The vacuum pump 154 absorbs air from the first column 152*a* and the carrier vaporization tube 151 connected to the first column 152*a*. Hence, air flows in a direction from the manifold 143 to the exhaust duct 162. Along with this flow, the carrier vapor is absorbed from the manifold 143 through the carrier vaporization tube 151 (Step S23). The carrier vapor at a temperature in a range between 60 and 100° C. is absorbed from the manifold 143 to the first column 152*a*.

Parallelly with the step S23, some carrier vapor is absorbed by the upper and lower fans 173 and 175 which are prepared for helping the collection of the carrier vapor (Step S24). Then, the absorbed carrier vapor flows into the second column 152*b* through two paths, as will be described below.

Because the temperature of the carrier vapor which has flowed from the opening of the manifold 143 is high, the carrier vapor travels upward due to convection of the vapor. The upper fan 173 absorbs the carrier vapor which has flowed upward from the opening of the manifold 143, and sends the absorbed carrier vapor to the second column 152*b* via the auxiliary tube 176*a*.

The carrier vapor from the developer inside the multicolor image formation section 123 may be vaporized at a room temperature. The carrier vapor is heavier than the air. Hence, the carrier vapor travels downward in the end due to the convection of the vapor. The lower fan 175 absorbs the carrier vapor which has traveled downward, and sends the absorbed carrier vapor to the second column 152*b* via the auxiliary tube 176*b*.

After the procedures of the steps S23 and S24, the carrier vapor is collected into the first and second columns 152*a* and 152*b*. The first column 152*a* and the second column 152*b* are internally connected, thereby to form the column 152.

The column 152 stores the coolant carrier (liquid) 155. The coolant carrier (liquid) 155 is cooled down to a predetermined temperature by the cooling device 159. The carrier vapor, at a high temperature, which has flowed into the column 152 passes through the coolant carrier (liquid) 155, so that the heat of the carrier vapor is absorbed by the coolant carrier (liquid) 155. In other words, the column 152 cools down the carrier vapor, and condenses the vapor (Step S25). The bottom of the column 152 is formed from a material having high thermal conductivity. The heat which is absorbed from the carrier vapor by the carrier (liquid) 155 is efficiently conducted to the cooling device 159. The heat which is conducted to the cooling device 159 is externally emitted by the heat sink 160, which externally penetrates through the printer 100, from the surface which is opposite to the surface through which the cooling device 159 contacts the column 152. Air-cooling is performed for the heat sink 160 by the cooling fan 161, thus efficiently emitting heat from the heat sink 160.

In the case where the cooling device 159 cools the coolant carrier (liquid) 155 too much, the liquid-temperature detector 158 detects that the temperature of the coolant carrier (liquid) 155 is equal to or lower than a predetermined temperature, and provides the controller 110 with a detection signal. The cooling device 159 is controlled off under the control of the controller 110.

Even after the carrier vapor is cooled down by the coolant carrier (liquid) 155, it still contains those carriers which have not been liquefied. The carrier vapor including such carriers, passes through the foaming member 156 upward together with the coolant carrier (liquid) 155, thereby to be foamed up and appear on the foaming member 156. The carrier vapor is cooled down and condensed while being maintained inside each bubble of the foam for a predetermined period. The liquefied carrier drops, when the foam is broken, incorporated with the coolant carrier (liquid) 155, and stored in the column 152. In other words, the foaming member 156 forms the carrier with the carrier vapor, so as to enhance liquefying of the carrier (Step S26).

The amount of carrier (liquid) inside the column 152 increases, because the carrier included in the carrier vapor is liquefied. If an excessive amount of the carrier (liquid) is included inside the column 152, the carrier vapor is unlikely to be liquefied. In order to avoid this, the carrier (liquid) which has increased more than a predetermined amount is output from the column 152. The process for outputting such carrier is as follows:

A large amount of carrier vapor is vaporized due to a continuous operation of the printer 100. Hence, the water level of the carrier (liquid) stored in the column 152 reaches a predetermined level. The water-level detector 157 detects that the carrier (liquid) has reached the predetermined level (Step S27), and provides the controller 110 with a detection signal. In response to the detection signal, the controller 110 provides the pump 182 with a drive-control signal.

In response to the drive-control signal, the pump 182 absorbs the carrier (liquid) by an amount increased since the initial state, and sends the absorbed carrier (liquid) to the multicolor image formation section 123 via the carrier tube 181 (Step S28).

After the carrier drawn from the column 152 is sent to the developer, the multicolor image formation section 123 agitates the developer with the carrier using the agitator under the control of the controller 110 (Step S29). The multicolor image formation section 123 re-uses the mixed developer for developing images (Step S30).

The carrier vapor having passed the foaming member 156, after being liquefied inside the column 152 in the step S26, is absorbed by the vacuum pump 154 (Step S31), and flows into the exhaust duct 162. The filter 163 of the exhaust duct 162 removes the remaining carrier from the carrier vapor (Step S32), and thereby outputting the carrier from the vent of the exhaust duct 162.

The wet-type electrophotographic printer 100 collects the carrier included in the developer, as described above. At this time, the wet-type electrophotographic printer 100 is so set to satisfy the conditions as follows:

(1) Carrier-Absorption Velocity for Maintaining Predetermined Quality of Output Image There is a close relationship between the carrier-absorption velocity and the quality of output image. In the case where the absorption belt 141 does not absorb an appropriate amount of carrier from the developer which is adhered onto the photo-conductor belt 121, the image to be output onto the paper 130 is deteriorated.

For example, when there is a high percentage of carrier included in the developer (remaining developer) remaining on the photo-conductor belt 121, after the absorption belt 141 absorbs the carrier, the adhesiveness of the remaining developer is low. Thus, a toner image is unlikely to be transferred from the photo-conductor belt 121 onto the transfer roller 124, resulting in failure in forming a predetermined output image.

When there is a low percentage of the carrier in the remaining developer, the adhesivenss of the developer is high. Thus, a toner image is likely to be transferred from the photo-conductor belt 121 onto the transfer roller 124. Note that if the percentage of the carrier in the remaining developer is too low, the absorption belt 141 absorbs the toner together with the carrier, or the remaining developer is fixed onto the transfer roller 124 after being transferred onto the transfer roller 124. This results in failure in fixing a predetermined output image onto the paper 130.

In order to form a predetermined output image, the absorption belt 141 is so set to absorb the carrier at an absorption velocity in a range between 1000 and 2000 (mg/min), so that several percent of the carrier in the remaining developer is maintained.

(2) Setting for Continuously Absorbing Carrier from Developer

In order for the absorption belt 141 to continuously absorb carrier from the developer on the photo-conductor belt 121, it is necessary to desorb (vaporize) the absorbed carrier, while the absorption belt 141 rotates one rotation. Hence, the temperature of the surface of the heat roller 142 for heating the absorption belt 141 is set in a range between 80° C. and 130° C. The temperature of the absorption belt 141 will be in a range between 50° C. and 100° C. by the heat of the heat roller 142. Then, the absorbed carrier is released from the entire surface of the absorption belt 141. The absorbed carrier is cleaned up from the absorption belt 141, during the one rotation, which will thus be back into a state where the absorption belt 141 has not absorbed the carrier yet.

(3) Pressure Setting for Continuously Absorbing Carrier from Developer

The concentration of the carrier vapor which is absorbed from the vapor vent of the manifold 143 through the carrier vaporization tube 151 is set equal to or smaller than, for example, 3000 ppm (parts per million).

In order to maintain this concentration, the absorption pressure of the vacuum pump 154 is set in a range between 5 and 10 (kPa), and the gas volume thereof is set in a range between 20 and 40 (Liter/min).

The pressure loss, as may be caused by the foaming member 156 inside the column 152, is set in a range between 2 and 3 (kPa). In this case, the foaming member 156 has the porosity of approximately 38%. Each of the holes of the foaming member 156 is approximately 50 $\mu$m in diameter.

(4) Setting for Maintaining Purity of Carrier and Enhancing Liquefaction of Carrier If the condensation ability of the column 152 is not high, highly-concentrated carrier vapor is output from the column 152. Thus, the filter 163 of the exhaust duct 162 is heavily loaded. As a result, the filter 163 does not last long.

To enhance concentration of the carrier vapor, it is preferred that the temperature of the coolant carrier (liquid) 155 in the column 152 is set as low as possible. However, if the temperature of the coolant carrier liquid) 155 is too low, the water vapor included in the carrier vapor is concentrated together with the carrier. As a result of this, the liquefied carrier is contaminated with water, thus can not be recycled. In order to prevent such contamination of the carrier, the vapor phase of the carrier needs to be shifted to a liquid phase, and the temperature of the carrier is adjusted in such a way that the vapor phase of the water vapor is maintained.

To accomplish this, the cooling device 159 is so set as to retain the temperature of the coolant carrier (liquid) 155 at approximately 20° C. This temperature is set in accordance with a difference between a saturation vapor pressure of the carrier and a saturation vapor pressure of the water, for example. It is desired that the amount of the coolant carrier (liquid) 155 is set in a range between 100 and 200 (mg).

Having set the above-described (1) to (4) conditions, the wet-type electrophotographic printer 100 can efficiently perform the carrier collection process shown in FIG. 2.

The concentration of the carrier vapor absorbed from the manifold 143 is approximately 3000 ppm. However, the concentration of the carrier output from the column 152 is equal to or smaller than 100 ppm. Hence, the liquefaction efficiency of the column 152, i.e. the percent of the carrier to be liquefied and included in the flowing carrier vapor, is equal to or larger than 95%.

The concentration of the carrier vapor flowing to the column 152 from the upper and lower ducts 171 and 172 is in a range between 100 and 300 ppm, whereas the concentration of the carrier vapor, when to externally be output is, equal to or smaller than 3 ppm.

According to UL standard for representing the index of safety control, the minimum guideline in the combustible range is set to 1/4LFL (Low Flammability Limit).

In the wet-type photographic printer 100, the setting of the concentration of the carrier to equal to or smaller than 1/4LFL can be realized.

The column 152 includes two entrances for carrier vapor. One of the two entrances is connected to the carrier vaporization tube 151, and the other one thereof is connected to the auxiliary tubes 176*a* and 176*b*. The carrier vaporization tube 151 absorbs the carrier vapor using the vacuum pump 154, whereas the auxiliary tubes 176*a* and 176*b* absorb the carrier vapor using the upper and lower fans 173 and 175.

The vacuum pump 154 is in a downstream position along the flow of the carrier vapor from the column 152, while the upper and lower fans 173 and 175 are in an upstream position along the flow of the carrier vapor.

Thus, the column 152 undergoes the absorption pressure from the vacuum pump 154 and the discharging pressure from the upper and lower fans 173 and 175. However, the partitioned columns 152*a* and 152*b* individually has an entrance for the carrier vapor. Thus, no interference should occur as a result of the absorption pressure and the discharging pressure.

The carrier vapors flowing respectively through the carrier vaporization tube 151, the auxiliary tubes 176*a* and 176*b* have various concentrations. The column 152 can handle liquefying the carrier vapors with different concentrations.

As explained above, the wet-type electrophotographic printer 100 can collect and condense the carrier vapor with high efficiency. According to the above structure of the wet-type electrophotographic printer 100, the amount of carrier to be filtered decreases, thus the filter can last long. The carrier, after being collected, is mixed with the developer and recycled. Thus, there is a long period of time before refilling the toner into the developer of the image formation section 123. Only a small amount of developer is filled in advance into the image formation section 123. This realizes miniaturization of the printer 100.

Second Embodiment

Figure 3:
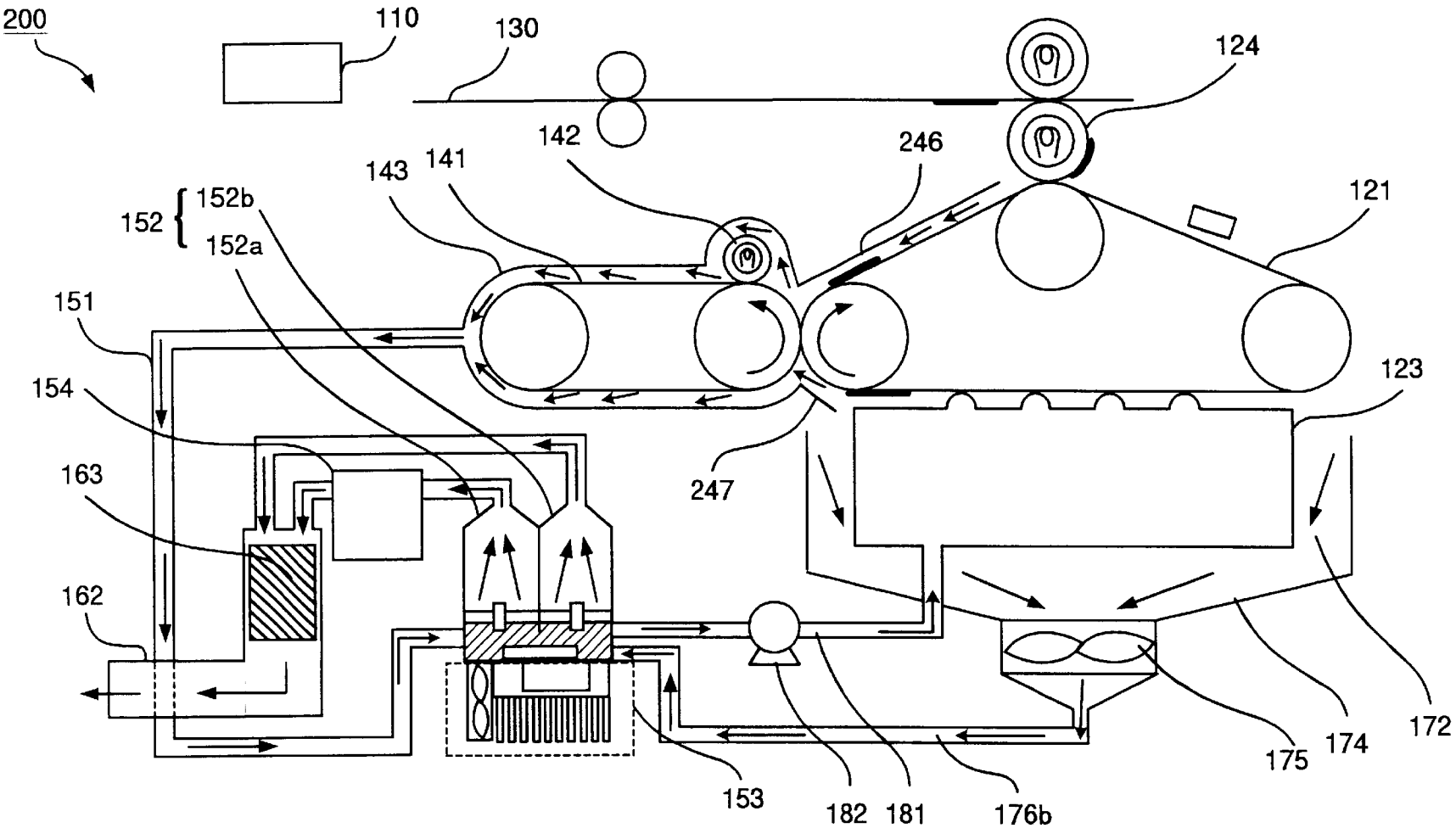
FIG. 3 is a diagram showing the structure of a wet-type electrophotographic printer according the second embodiment of the present invention.

FIG. 3 is a diagram showing the structure of a wet-type electrophotographic printer according to the second embodiment of the present invention.

A wet-type electrophotographic printer 200 has basically the same structure as that of the wet-type electrophotographic printer according to the first embodiment, except the mechanism for additionally collecting the carrier vapor.

As shown in FIG. 3, a manifold upper plate 246 and a manifold under plate 247 are adhered to the opening of the manifold 143.

The manifold upper plate 246 is connected to the opening of the manifold 143, so as to cover the surface of the photo-conductor belt 121 in a downstream position of the rotational direction thereof, in a range from the opening of the manifold 143 to the transfer roller 124.

The manifold under plate 247 is connected to the opening of the manifold 143, so as to cover the surface of the photo-conductor 121 in an upstream position of the rotational direction thereof.

The manifold upper plate 246 and the manifold under plate 247 prevent scattering of the carrier vapor which is vaporized by the heat from the absorption belt 141, thereby to enhance the vacuum pump 154 in collecting the carrier vapor.

The carrier vapor, which is vaporized by the heat of the heat roller 142, flows into the first column 152*a* via the carrier vaporization tube 151 along the air-flow among the manifold upper plate 246, the manifold under plate 247 and the photo-conductor belt 121.

Accordingly, the wet-type electrophotographic printer 200 does not include the upper duct 171, the upper fan 173 and the auxiliary tube 176*a* which are included in the printer 100 of the first embodiment. Hence, the structure of the wet-type electrophotographic printer 200 is simply formed.

Third Embodiment

Figure 4:
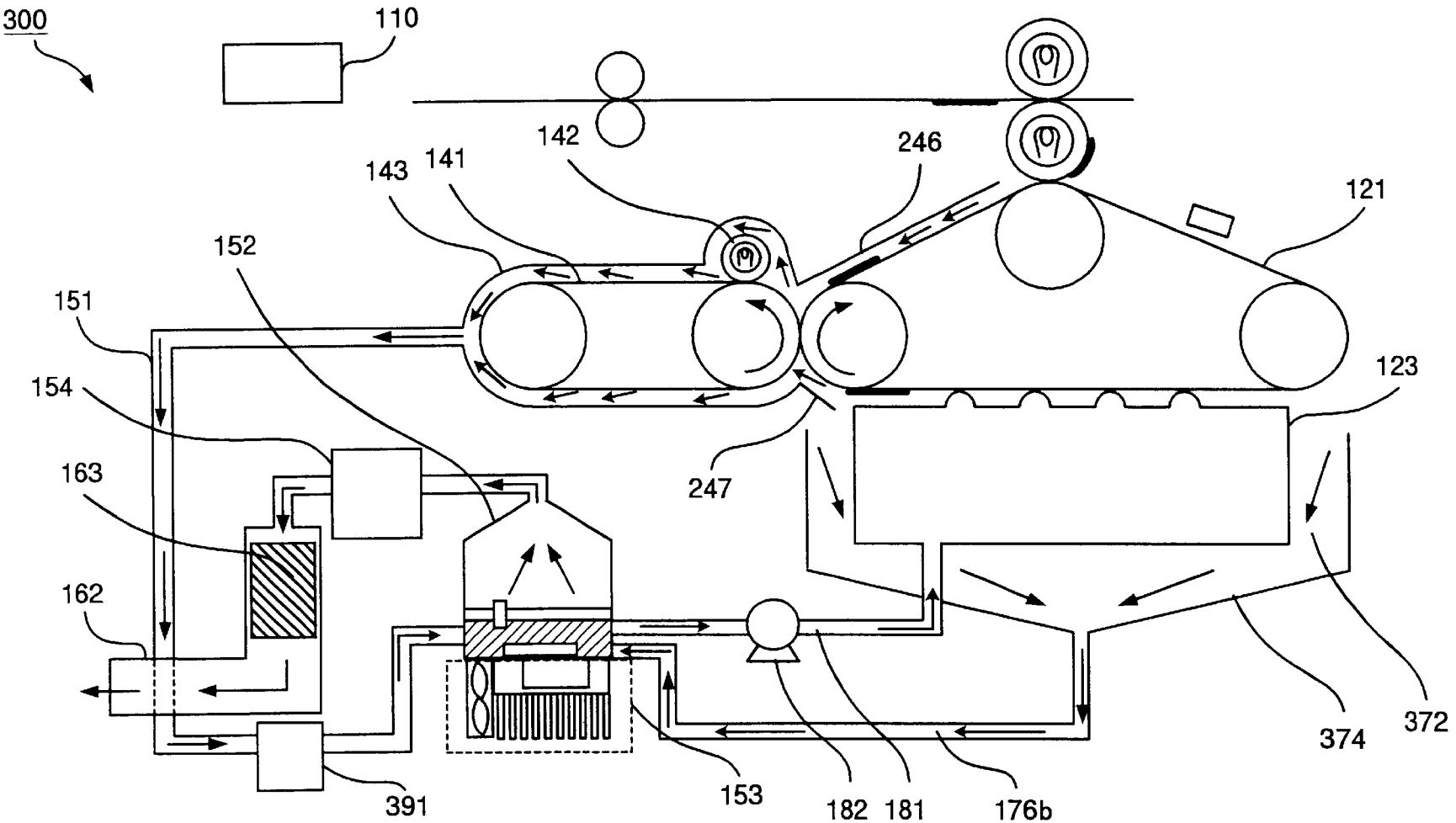
FIG. 4 is a diagram showing the structure of a wet-type electrophotographic printer according to the third embodiment of the present invention.

FIG. 4 is a diagram showing the structure of a wet-type electrophotographic printer according to the third embodiment of the present invention.

A wet-type electrophotographic printer 300 has the same structure as that of the wet-type electrophotographic printer 200 of the second embodiment. What differs between the wet-type electrophotographic printers 200 and 300 is a method for adjusting gas volume and pressure of each path for collecting the carrier vapor.

The wet-type electrophotographic printer 300 includes a gas-volume adjuster 391 for adjusting the gas volume and pressure in each path for collecting the carrier vapor.

The gas-volume adjuster 391 is arranged between the manifold 143 and the column 152, and balances the gas-volume and pressure inside the carrier vaporization tube 151, with the gas-volume and pressure inside the auxiliary tube 176b.

The carrier vapor flows into the column 152, in accordance with the absorption pressure of the vacuum pump 154, via the carrier vaporization tube 151 and the auxiliary tube 176*b*. The gas-volume adjuster 391 balances the gas-volume and pressure inside the carrier vaporization tube 151, with the gas-volume and pressure inside the auxiliary tube 176*b*. Hence, there is no need to divide the column 152 included in the wet-type electrophotographic printer 300.

The vacuum pump 154 absorbs not only the carrier vapor flowing through the carrier vaporization tube 151, but also the carrier vapor flowing through the auxiliary tube 176*b*. The lower duct 372 need not include any fans, thus includes only a tray 374.

Fourth Embodiment

Figure 5:
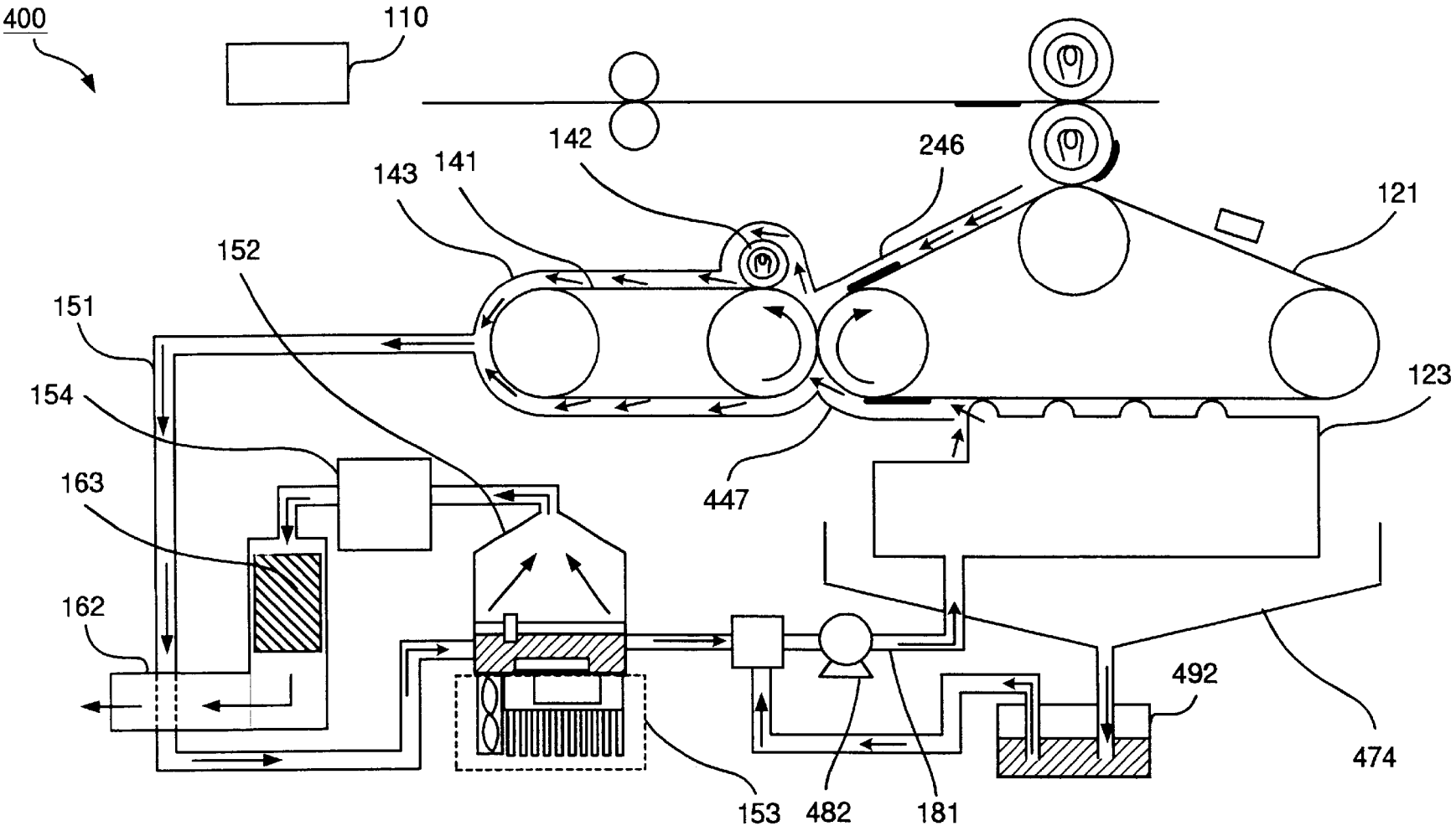
FIG. 5 is a diagram showing the structure of a wet-type electrophotographic printer according to the fourth embodiment of the present invention.

FIG. 5 is a diagram showing the structure of a wet-type electrophotographic printer according to the fourth embodiment of the present invention.

A wet-type electrophotographic printer 400 has basically the same structure as the printer 300 of the third embodiment. What differs between the wet-type electrophotographic printers 300 and 400 is the mechanism for enhancing the collection of carrier vapor.

A manifold under plate 447 is connected to the opening of the manifold 143, as shown in FIG. 5, and covers the area along the surface of the photo-conductor 121 in a range from the opening of the manifold 143 to the multicolor image formation section 123.

A very slight amount of carrier vapor is collected from the carrier vaporization tube 151 by the manifold upper plate 246 and the manifold under plate 447.

In the wet-type electrophotographic printer 400, the concentration of the carrier is lower than the concentration of the carrier in any of the wet-type electrophotographic printers 100, 200 and 300 of the first to third embodiments. The carrier collected onto the tray 474 is spontaneously liquefied, and stored into a reserve tank 492 right underneath the tray 474.

The reserve tank 492 is connected to the carrier tube 181. The carrier stored in the reserve tank 492 is periodically drawn by the pump 482, and sent to the multicolor image formation section 123.

In the wet-type electrophotographic printer 400 of this embodiment, because the auxiliary tube for enhancing the collection of a slight amount of carrier vapor inside the printer is not required, the gas-volume adjuster is not necessary as well. Thus, the volume of the vacuum pump 154 and column 152 can be small, realizing the miniaturization of the printer.

Fifth Embodiment

Figure 6:
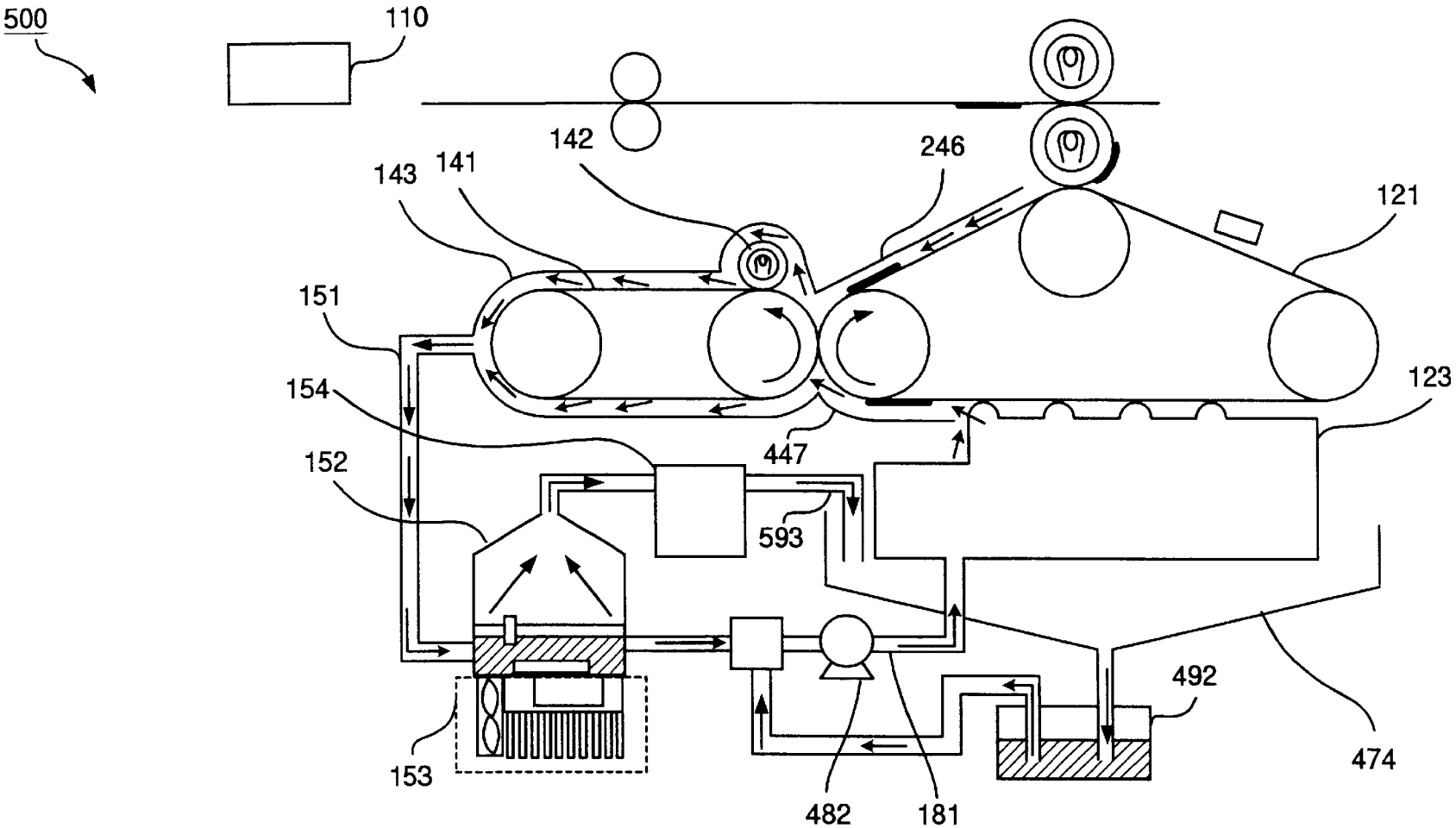
FIG. 6 is a diagram showing the structure of a wet-type electrophotographic printer according to the fifth embodiment of the present invention.

FIG. 6 is a diagram showing the structure of a wet-type electrophotographic printer according to the fifth embodiment of the present invention.

A wet-type electrophotographic printer 500 has basically the same structure as that of the wet-type electrophotographic printer 400 of the fourth embodiment, and differs from one aspect that the carrier vapor needs not be exhausted in the printer 500 of this embodiment.

In the wet-type electrophotographic printer 500, the concentration of the carrier is low, likewise in the wet-type electrophotographic printer 400.

The vent of the column 152 is connected to a nozzle 593, which is inserted into the tray 474, via the vacuum pump 154.

The carrier vapor which has not been liquefied inside the column 152 is absorbed from the column 152 by the vacuum pump 154, and sent from the nozzle 593 to the tray 474.

Because the concentration of the carrier vapor sent to the tray 474 is low, the carrier vapor is spontaneously liquefied, and stored in into the reserve tank 492. Then, the stored carrier vapor is periodically sent to the multicolor image formation section 123 by the pump 482, and reused for developing images again.

The wet-type electrophotographic printer 500 of this embodiment does not externally exhaust the carrier vapor, hence no filter is required. Filters are generally to be replaced with new filters periodically. Because no filter is required in the wet-type electrophotographic printer 500 of this embodiment, the task for replacing the filter is not necessary.

Sixth Embodiment

Figure 7:
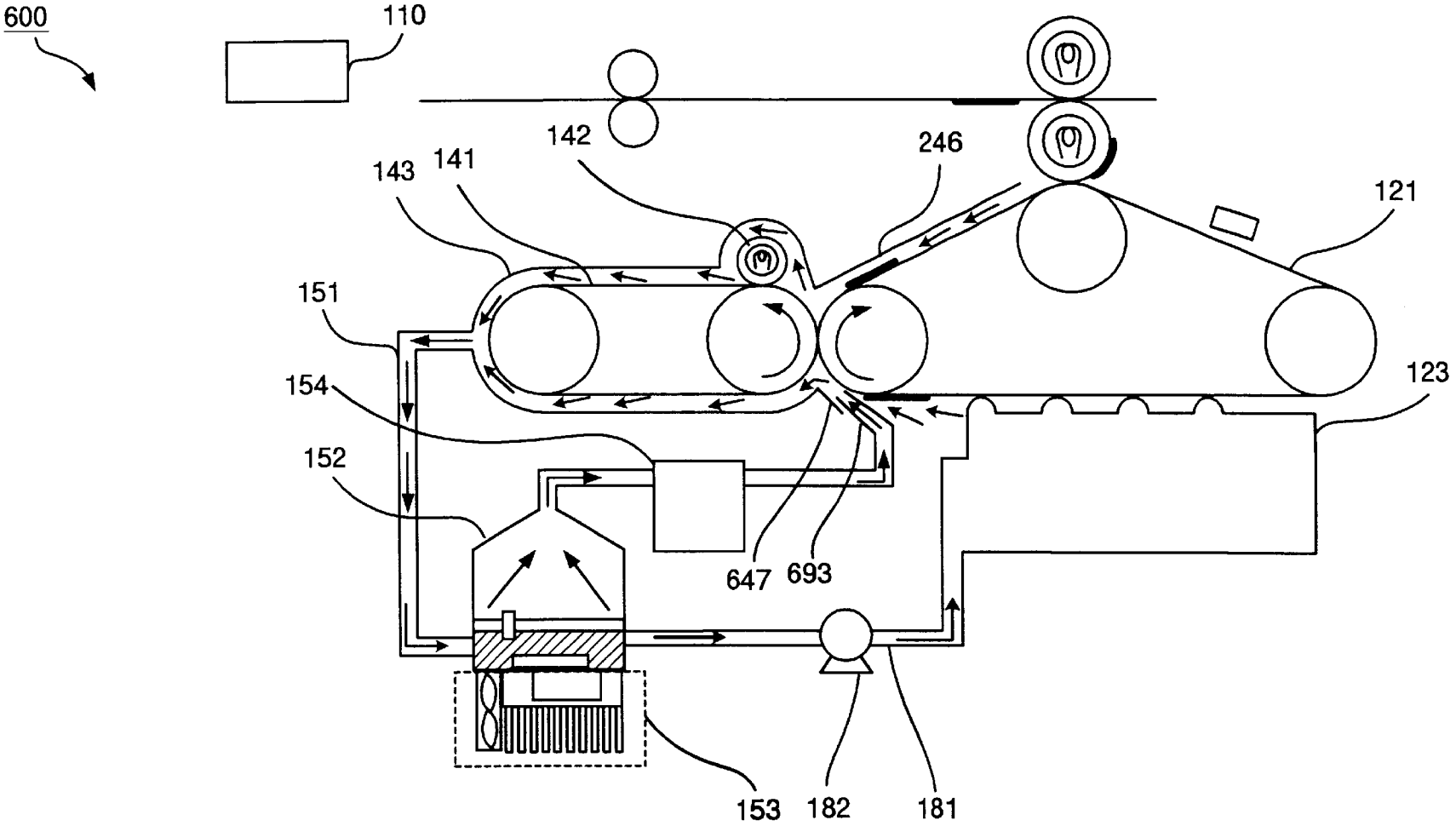
FIG. 7 is a diagram showing the structure of a wet-type electrophotographic printer according to the sixth embodiment of the present invention.

FIG. 7 is a diagram showing the structure of a wet-type electrophotographic printer according to the sixth embodiment of the present invention.

A wet-type electrophotographic printer 600 has basically the same structure as that of the wet-type electrophotographic printer 500. In the structure of the wet-type electrophotographic printer 600, what differs from the structure of the printer 500 is that the carrier is circulated through, until it gets liquefied in the column 152.

In the wet-type electrophotographic printer 600, the concentration of the carrier is low, likewise in the wet-type electrophotographic printer 500 of the fifth embodiment.

The vent of the column 152 is connected to a nozzle 693 through the vacuum pump 154. The nozzle 693 is inserted into the manifold 143 from the space between the manifold under plate 647 and the photo-conductor belt 121.

The carrier vapor output to the manifold 143 is absorbed by the vacuum pump 154, and flows into the column 152 via the carrier vaporization tube 151.

The carrier, which has not been liquefied in the column 152, is absorbed by the vacuum pump 154 from the column 152 again, and sent to the manifold 143 from the nozzle 693.

The wet-type electrophotographic printer 600 of this embodiment does not need any place for storing the carrier, such as the reserve tank 492, etc., other than the column 152.

Hence, the structure of the wet-type electrophotographic printer 600 is more simpler than that of the wet-type electrophotographic printer 500 of the fifth embodiment.

In the wet-type electrophotographic printer according to any one of the first to sixth embodiments, the vapor collection tube around the absorption belt has been described as the manifold. However, as long as the vapor collection tube is one to prevent the scattering of the carrier vapor, the shape and structure thereof is arbitrary. In the above-described embodiments, the absorption device for absorbing the carrier vapor has been descried as the vacuum pump. However, the absorption device may include an axial fan, for example.

Various embodiments and changes may be made thereonto without departing from the broad spirit and scope of the invention. The above-described embodiments are intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2000-041044 filed on Feb. 18, 2000, and including specification, claims, drawings and summary. The disclosure of the above Japanese Patent Application is incorporated herein by reference in its entirety.

What is claimed is:

1. A carrier collection device for collecting a carrier from a developer, including a toner and the carrier, after being used for developing an electrostatic latent image formed on a photo-conductor, said device comprising:

an absorption belt which is arranged adjacent to said photo-conductor, and rotated in a direction opposite to a rotational direction of said photo-conductor, so as to absorb the carrier;

a heat source which heats said absorption belt, and generates a carrier vapor from said absorption belt;

a vapor collection tube which surrounds said absorption belt and has a vent for the carrier vapor;

an absorption device which absorbs the carrier vapor from the vent of said vapor collection tube; and a condenser which is arranged between said vapor collection tube and said absorption device, stores, in advance, a coolant carrier, includes a foaming member for foaming a carrier included in the carrier vapor, on the coolant carrier, receives the carrier vapor from said vapor collection tube, condenses the received carrier vapor through the coolant carrier and the foaming member, and stores the condensed carrier together with the coolant carrier.

2. The carrier collection device according to claim 1, further comprising:

a cooling device which is in contact with said condenser, and cools the carrier stored in said condenser;

a liquid-temperature detector which detects a temperature of the carrier stored in said condenser; and a controller which controls an operation of said cooling device, and maintains the carrier stored in said condenser at a predetermined temperature, based on the temperature measured by said liquid-temperature detector.

3. The carrier collection device according to claim 2, wherein said controller maintains the carrier stored in said condenser at a temperature at which a vapor phase of the carrier is likely to shift to a liquid phase, and at which a vapor phase of a water vapor can be sustained.

4. The carrier collection device according to claim 3, further comprising:

a carrier absorption device which absorbs the carrier stored in said condenser; and a liquid-level measurement device which measures a liquid level of the carrier stored in the condenser, and wherein said controller controls said carrier absorption device, and retains the liquid level of the carrier stored in the condenser within a predetermined range, based on the liquid level measured by said liquid-level measurement device.

5. The carrier collection device according to claim 4, wherein said carrier absorption device absorbs the carrier by an amount increased from an original point of a water level of the carrier stored in advance, under control of said controller.

6. The carrier collection device according to claim 5, wherein:

said carrier absorption device sends the absorbed carrier to an image formation section for visualizing an electrostatic latent image on said photo-conductor; and said controller controls an agitator for agitating the absorbed carrier sent to the image formation section with a developer included in the image formation section.

7. A carrier collection device for collecting a carrier from a developer, including a toner and the carrier, after being used for developing an electrostatic latent image formed on a photo-conductor, said device comprising:

an absorption belt which is arranged adjacent to the photo-conductor, and absorbs the carrier by rotating in a direction opposite to a rotational direction of the photo-conductor;

a heat source which heats said absorption belt and generates a carrier vapor;

a vapor collection tube which includes an opening in an area adjacent to the photo-conductor and said absorption belt, surrounds said absorption belt, and has a vent for the carrier vapor;

an absorption device which absorbs the carrier vapor from the vent of said vapor collection tube;

a condenser which receives the carrier vapor from the vent of said vapor collection tube, condenses the received carrier vapor, and collects the condensed carrier;

a duct one end of which partially or fully covers the opening of said vapor collection tube, and other end of which is connected to said condenser; and a fan which is included in said duct, and collects the carrier vapor flowing from the opening of said vapor collection tube.

8. The carrier collection device according to claim 7, wherein said condenser is partitioned into a first column for liquefying the carrier vapor absorbed by said absorption device and a second column for liquefying the carrier vapor absorbed by said fan, thereby no interference occurs from an absorption pressure of said absorption device and an absorption pressure of said fan.

9. The carrier collection device according to claim 8, further comprising:

a lower duct one end of which is arranged under an image formation section for visualizing an electrostatic latent image on said photo-conductor, and other end of which is connected to the second column and collects a carrier vapor vaporized from the image formation section; and a lower fan which is included in said lower duct, absorbs the carrier vapor vaporized from the image formation section, and sends the absorbed carrier vapor to the second column.

10. A carrier collection device for collecting a carrier from a developer, including a toner and the carrier, after being used for developing an electrostatic latent image formed on a photo-conductor, said device comprising:

an absorption belt which is arranged adjacent to said photo-conductor, and rotated in a direction opposite to a rotational direction of said photo-conductor, thereby to absorb the carrier;

a heat source which heats said absorption belt, and generates a carrier vapor;

a vapor collection tube which includes an opening in an area adjacent to said photo-conductor and said absorption belt, surrounds said absorption belt, and includes a vent for the carrier vapor;

an absorption device which absorbs the carrier vapor from the vent of said vapor collection tube;

a condenser which receives the carrier vapor from the vent of said vapor collection tube, condenses the received carrier vapor, and collects the condensed carrier; and a photo-conductor cover which is connected to the opening of said vapor collection tube, and partially or fully covers a surface of said photo-conductor from the opening.

11. The carrier collection device according to claim 10, further comprising:

a carrier absorption device which periodically sends the condensed carrier collected by said condenser to an image formation section for visualizing an electrostatic latent image on said photo-conductor; and a tray, in a conical form, which has an opening arranged under the image formation section, and collects a carrier vapor vaporized from the image formation section.

12. The carrier collection device according to claim 11, wherein:

said absorption device absorbs the carrier vapor collected by said tray, and sends the absorbed carrier vapor to said condenser; and a gas-volume adjuster which is arranged between said vapor collection tube and said condenser, and adjusts a gas volume of the carrier vapor flowing to said condenser.

13. The carrier collection device according to claim 11, further comprising a tank which is connected to a bottom section of said tray, and stores the condensed carrier from the tray, wherein:

said photo-conductor cover covers the surface of said photo-conductor in an upstream position of the rotational direction of said photo-conductor, in a range from the opening of said vapor collection tube to the image formation section arranged in an upstream position of the rotational direction of said photo-conductor; and said carrier absorption device sends the carrier stored in said tank to the image formation section.

14. The carrier collection device according to claim 13, wherein a vent of said condenser is connected to a nozzle inserted into said tray, via said absorption device, thereby a carrier vapor which has not been liquefied in said condenser is sent from the nozzle to the tray.

15. The carrier collection device according to claim 10, wherein a vent of said condenser is connected to a nozzle, inserted into said vapor collection tube from a space between said photo-conductor cover and said photo-conductor, via said absorption device, thereby a carrier vapor which has not been liquefied in said condenser is sent from the nozzle to said vapor collection tube.

16. A method for collecting a carrier from a developer, including a toner and the carrier (liquid), after being used for developing an electrostatic latent image on a photo-conductor, said method comprising:

absorbing the carrier from said photo-conductor onto an absorption belt;

heating and vaporizing the carrier absorbed onto the absorption belt with a heat source;

absorbing, with an absorption device, the carrier vapor vaporized in said heating, and conducting the absorbed carrier vapor to a condenser in which a coolant carrier is stored in advance;

cooling and condensing the carrier vapor, which is absorbed in said absorbing, in the coolant carrier stored in advance in the condenser, and storing the condensed carrier; and foaming the carrier vapor, which has passed through the coolant carrier, using a foaming member arranged on the coolant carrier, condensing the foamed carrier by retaining the foamed carrier on the foaming member for a predetermined period of time, and storing the condensed carrier in said condenser.

17. The method according to claim 16, further comprising periodically transferring the carrier stored in said condenser onto an image formation section for visualizing an electrostatic latent image on the photo-conductor.

18. The method according to claim 17, wherein said transferring includes:

detecting that an amount of carrier stored in said condenser reaches a predetermined level; and absorbing a predetermined amount of carrier from the condenser, when detected that the amount of carrier reaches the predetermined level.

* * * * *